US006969257B2

(12) United States Patent
Groen

(10) Patent No.: US 6,969,257 B2
(45) Date of Patent: Nov. 29, 2005

(54) GOLF SWING TIMING/TRAINING DEVICE

(76) Inventor: Henry Jay Groen, 2401 Pennsylvania Ave., NW, Suite 708, Washington, DC (US) 20037

( * ) Notice: Subject to any disclaimer, the term of this patent is extended or adjusted under 35 U.S.C. 154(b) by 66 days.

(21) Appl. No.: 10/795,150

(22) Filed: Mar. 4, 2004

(65) Prior Publication Data

US 2005/0196738 A1 Sep. 8, 2005

(51) Int. Cl.[7] ..... A63B 69/36
(52) U.S. Cl. ..... 434/252; 473/212
(58) Field of Search ..... 473/207, 212, 473/213, 226, 233, 234, 276; 434/247, 252; 63/15, 15.7, 12, 13, 23

(56) References Cited

U.S. PATENT DOCUMENTS 3,156,211 A * 11/1964 Mallory, Jr. ..... 473/211
3,528,664 A * 9/1970 Gunn, Jr. ..... 473/213
4,364,564 A 12/1982 Lewis
4,614,343 A * 9/1986 Radway ..... 473/234
4,953,868 A * 9/1990 Thompson et al. ..... 473/234
4,967,596 A * 11/1990 Rilling et al. ..... 73/492
5,005,835 A * 4/1991 Huffman ..... 473/209
5,108,103 A 4/1992 Rilling
5,471,199 A 11/1995 Yuan
5,607,361 A 3/1997 Mastandrea et al.
5,634,856 A * 6/1997 Rainey ..... 473/234
5,688,183 A 11/1997 Sabatino et al.
5,743,805 A 4/1998 Richter
5,743,806 A 4/1998 Brennan
5,836,829 A 11/1998 Van Cott et al.
5,860,873 A 1/1999 Karasavas
5,871,406 A 2/1999 Worrell
5,876,292 A 3/1999 Hamilton
5,984,796 A * 11/1999 Mah ..... 473/215
6,279,243 B1 8/2001 Tranas
6,461,163 B1 10/2002 Gallagher et al.
6,539,551 B1 4/2003 Jones, Jr.
6,719,639 B2 * 4/2004 Novosel, Sr. ..... 473/213

* cited by examiner

*Primary Examiner*—Kien Nguyen
(74) *Attorney, Agent, or Firm*—Sughrue Mion, PLLC

(57) ABSTRACT

A golf swing timing training aid for perfecting a golf swing that provides both an audible and vibrational feedback indicator when the apogee of a back swing has been reached, when the swing accelerates downward, and when the apogee of the follow-through swing has been reached. The golf swing training aid is unobtrusive and inconspicuous, and is capable of being hidden within a golf glove.

35 Claims, 5 Drawing Sheets

GOLF SWING TIMING/TRAINING DEVICE

FIELD OF THE INVENTION

The present invention relates to a golf swing timing/training device for improving the golf swing of a golfer. More particularly, the present invention is directed to a training device that aids the golfer in obtaining and maintaining a proper golf club swing tempo so as to perfect the swing.

BACKGROUND OF THE INVENTION

Many golf-swing training devices exist, and common traits include complexity and obtrusiveness. For example, U.S. Pat. No. 5,108,103 discloses a velocity transducer device capable of strapping to various joints of the human body, including the knees, arms and wrists; U.S. Pat. No. 5,743,805 discloses a device that, once strapped to the forearm, "clicks" in conjunction with bending the arm; U.S. Pat. No. 5,876,292 discloses an additional "clicker" device that straps to the human body; and U.S. Pat. No. 6,461,163 discloses an electronic device for mounting to the back of a golfer's hand that provides an audible signal denoting particular wrist angle.

These and other golf-swing training devices are so obtrusive and conspicuous that their use gives pause to the casual observer, making the user extremely self-conscious. Such is detrimental to perfecting a good golf swing because the student of the swing is brought out of the "flow," or "zone" of concentration. Most professional golf instructors teach that stance, form and delivery of a swing are crucial. However, due to the previously mentioned problems, the prior art devices detract both physically and mentally from a user's stance, form and delivery.

SUMMARY OF THE INVENTION

Accordingly, it is a general object of the present invention to provide a golf swing timing-training aid which overcomes all of the disadvantages described above and other disadvantages of the prior art. It is also a general object of the instant invention to provide a golf swing timing-training aid that is easily concealable, unobtrusive, inconspicuous, and reliable.

BRIEF DESCRIPTION OF THE DRAWINGS

The invention, both as to its organization and manner of operation, may be further understood by reference to the drawings that include FIGS. 1–5, taken in connection with the following descriptions.

DETAILED DESCRIPTION OF EMBODIMENTS

The following description of illustrative, non-limiting embodiments of the invention discloses specific configurations and components. However, the embodiments are merely examples of the present invention, and thus, the specific features described below are merely used to describe such embodiments and to provide an overall understanding of the present invention. Accordingly, one skilled in the art will readily recognize that the present invention is not limited to the specific embodiments described below. Furthermore, the descriptions of various configurations and components of the present invention that are known to one skilled in the art are omitted for the sake of clarity and brevity.

Figure 1:
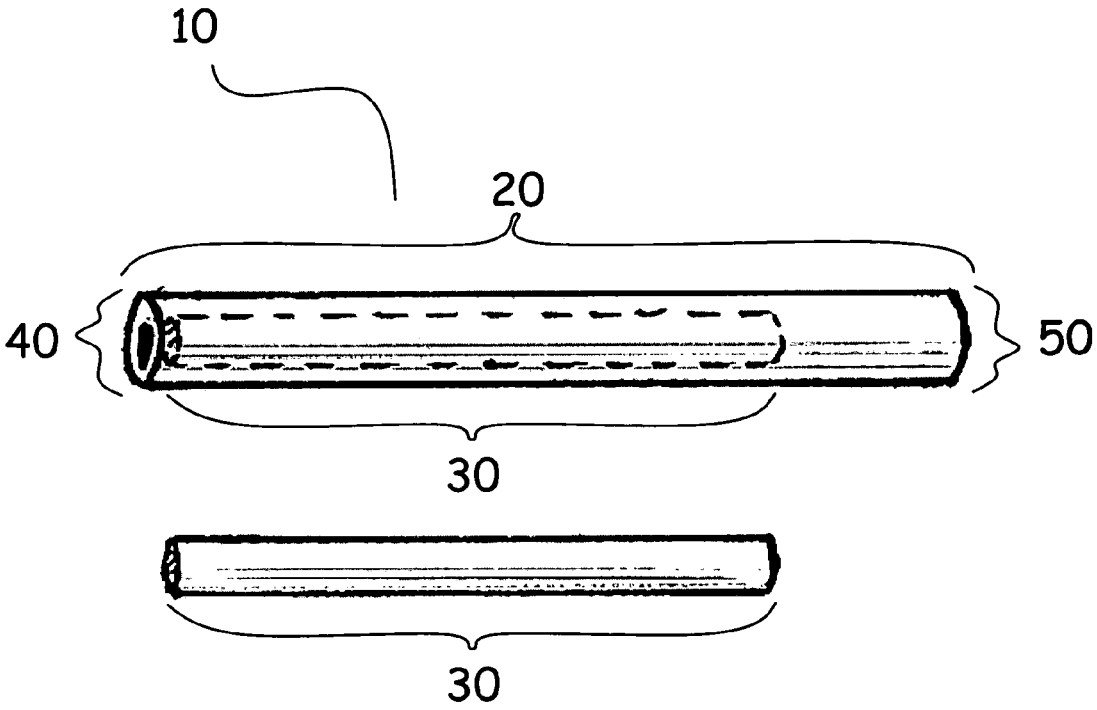
FIG. 1 is an illustration of an embodiment of the invention.

FIG. 1 illustrates an embodiment of the invention. As shown, the golf swing timing-training aid includes a body 10. The body 10 includes a tubular member 20, and the tubular member 20 includes a first end 40 and a second end 50. Internal to tubular member 20 is a rod 30.

The body 10 helps to ingrain the best swing for a particular user by signaling proper pace and position of the hands through production of a muted vibration and audible "ding" at key points during the course of a swing (as further explained herein in relation to FIGS. 3–6). The vibration and audible "ding" promote:

- slow and complete back swing (apogee of the back swing);
- proper wrist cock;
- proper "wait" on the ball;
- proper down-swing acceleration (proper range of pace); and
- proper follow-through (apogee of the follow-through swing).

While the rod 30 is shown in FIG. 1 in positions both internal and external to tubular member 20, such illustration is purely for purposes of providing an illustration of components. In functional operation, the rod 30 is located within tubular member 20. The first end 40 and the second end 50 of the tubular member 20 are constructed so as to prevent the rod 30 from exiting the tubular member 20, while simultaneously allowing the rod 30 to travel freely within the confines of the tubular member 20.

In an exemplary, non-limiting embodiment, both the tubular member 20 and the rod 30 are made of metal. For example, the tubular member 20 may be copper or copper alloy and the rod 30 may be any metal with a specific gravity greater than about two (2). In additional embodiments, one or the other (or both) of the tubular member 20 and the rod 30 may be made of plastic or ceramic. In all embodiments, however, the tubular member 20 has an outer diameter of less than about ⅜ of an inch. In exemplary embodiments, it is desirable that the outer diameter of the tubular member be less than about 5/16 of an inch. In a specific exemplary embodiment, the outer diameter of the tubular member 20 is approximately ¼ inch. The size of the outer diameter of the tubular member 20 is designed to be relatively small so as to be inconspicuous and unobtrusive.

The inventor has discovered that the qualities of inconspicuousness and unobtrusiveness require that the internal structure of the device consist of a rod or rod-like piece, such as the rod 30 as described herein. In comparison, the use of balls or bearings instead of the rod 30 requires a tubular outer member of a diameter that is greater than about ¾ of an inch to meet an approximate amount of mass equivalent to that mass in the rod 30 of the instant invention.

Stated differently, the present invention provides a vibration and audible "ding" at key moments of a golf swing, and yet is inconspicuous and unobtrusive. If bearings or balls were to be used instead of the rod 30, the resultant device would be much larger than the device of the instant invention, thereby losing the qualities of inconspicuousness and unobtrusiveness. Additionally, balls and bearings roll too early in the swing, failing to properly denote precise timing of the key moments of a swing, and hence they are not preferred.

Depending on the golfer's hand and swing, the instant invention uses a tubular member 20 that is approximately 1.75 inches long (thereby maintaining the qualities of unobtrusiveness and inconspicuousness) in conjunction with a rod 30 that is approximately ¾ the length of the tubular member 20. In most materials useful for making the instant invention, a rod 30 being approximately ¾ the length of the tubular member 20 provides a correct amount of friction for a properly timed back swing.

Indeed, the friction coefficient between the rod 30 and the tubular member 20 provides that the rod 30 will not slide down the tubular member 20 during a backswing until the back swing has reached the near vertical position. In contrast, bearings or balls (in addition to failing to provide the correct amount of mass for a comparably sized tubular member to produce an audible and vibrational indicator of the same level of magnitude) roll too early, thereby not properly indicating the near vertical position of a club in a back swing.

Qualities in addition to unobtrusiveness and inconspicuousness include the audible and vibrational feedback indication feature of the golfer having reached the apogees of both the back swing and the follow-through. In an exemplary embodiment, calibration of the drag coefficient between the rod 30 and the tubular member 20 provides for proper "critical" timing or swing tempo. "Critical" timing for the previously noted apogees falls within a modest range for most golfers, but occurs when the club is in the near vertical positions in both the back swing and the follow-through.

The time that it takes the rod 30 to travel the length of the tubular member 20, from first end 40 to second end 50, is a function of the drag coefficient of the materials used. That is, the velocity, or time it takes for the rod 30 to move down the tubular member 20 as the tubular member 20 is tilted vertically in a back swing, is a function of the specific gravity of the rod 30. Various embodiments of rod 30 include metal materials with different specific gravities. Measuring the varying slide times resulting from these different specific gravities allows for a device that can be calibrated.

For instance, consider that an object sinks through liquid or gas due to the attractive force of gravity. A general equation of this notion is provided by:

$$F_b = -mv\rho g$$

Where v is the specific volume of the object (volume per unit of mass), ρ is the density of the medium, and g is the gravitational acceleration. Accordingly, (m v) gives the volume of the object, and (ρ g) gives the gravitational force per unit volume of the fluid. Since g is negative, the minus sign indicates that buoyant force is directed upward.

When $F_g < F_b$, the object "floats." When $F_g > F_b$, the object "sinks." By substituting the buoyant force of the gas or liquid with the friction of the tubular member 20 against the rod 30 (while holding the volume of the rod 30 constant), it is clear that by varying the density of the rod 30, the velocity of the rod 30 is also directly varied.

Commonly available materials that can be used to make the rod 30 include materials of varying densities. For instance, the specific gravity of tin is 7.2 to 7.5; of stainless steel is 7.7 to 7.8; of brass is 8.4 to 8.7; of nickel is 8.9; of silver is 10.4 to 10.6; and tungsten is 19.22. In an exemplary embodiment, brass has been found to provide an acceptable friction coefficient when used as the rod 30, with copper or copper alloy being used as the tubular member 20, wherein the rod 30 is approximately ¾ the length of the tubular member 20 and the tubular member 20 is approximately ¼ inch in diameter.

Figure 2:
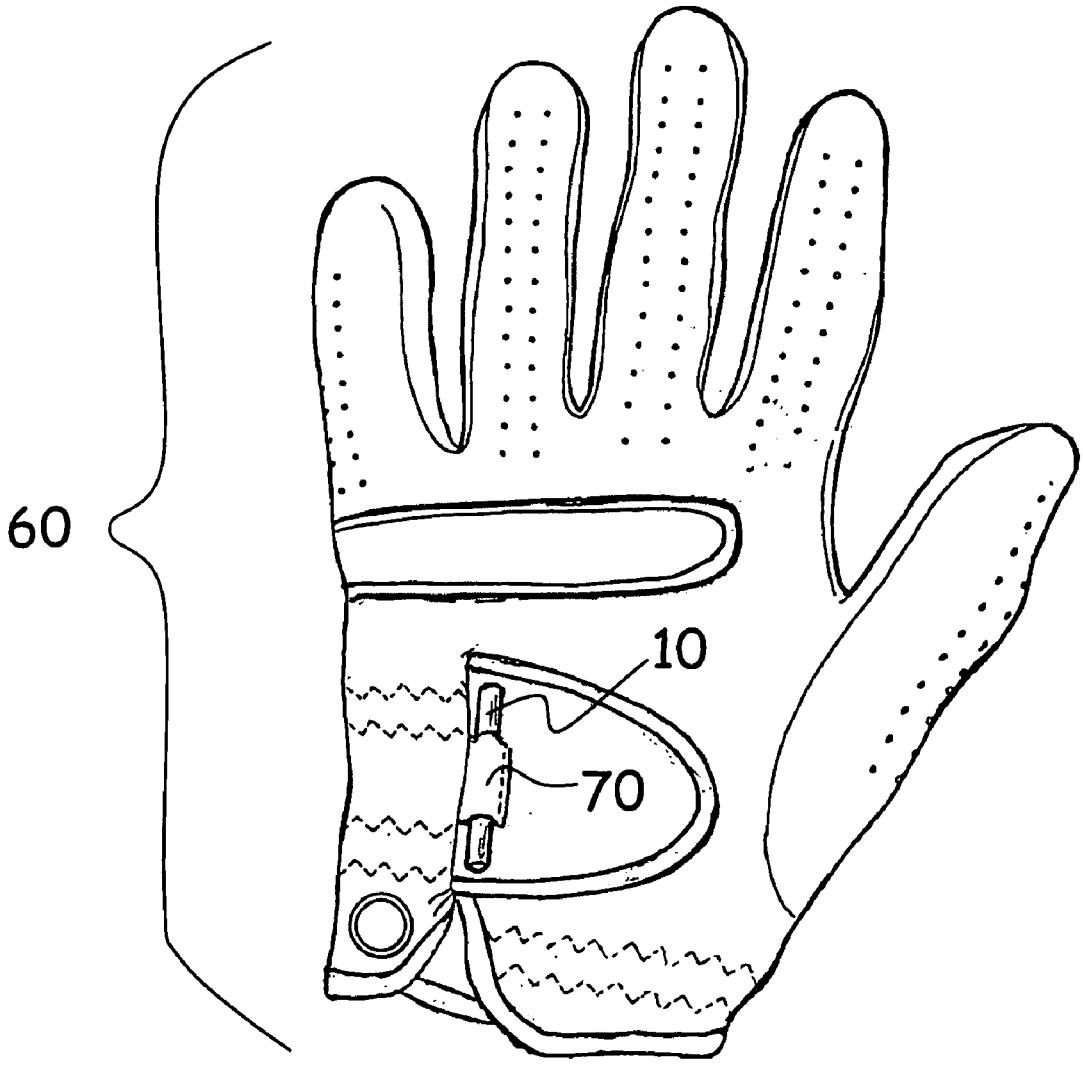
FIG. 2 is an example of a non-limiting embodiment of the invention including a golf glove.

FIG. 2 illustrates a further embodiment of the invention in which the body 10 is attached to a golfing glove 60 by an attachment means 70. The attachment means 70 may be elastic, cloth, leather, Velcro™, glue, tape or epoxy, or may be thread, cord or wire. Further, attachment means 70 might further include a pouch or pocket. Indeed, nearly any form of connectivity could be used to connect the body 10 to the golf glove 60, so long as the body 10 were to take a position which would be generally parallel to the fingers of the glove, or generally parallel to the metacarpal bones of a hand wearing the glove.

In various embodiments, the body 10 is completely covered by the attachment means 70, hiding the body 10 within the confines of the glove 60. In an additional embodiment, the body 10 is not attached to a glove 60, but merely taped to the back of a user's hand in a position where the body 10 is generally parallel to the user's third metacarpal bone. In yet an additional embodiment, the body 10 is attached to a golf club and not to a golf glove 60.

Figure 3:
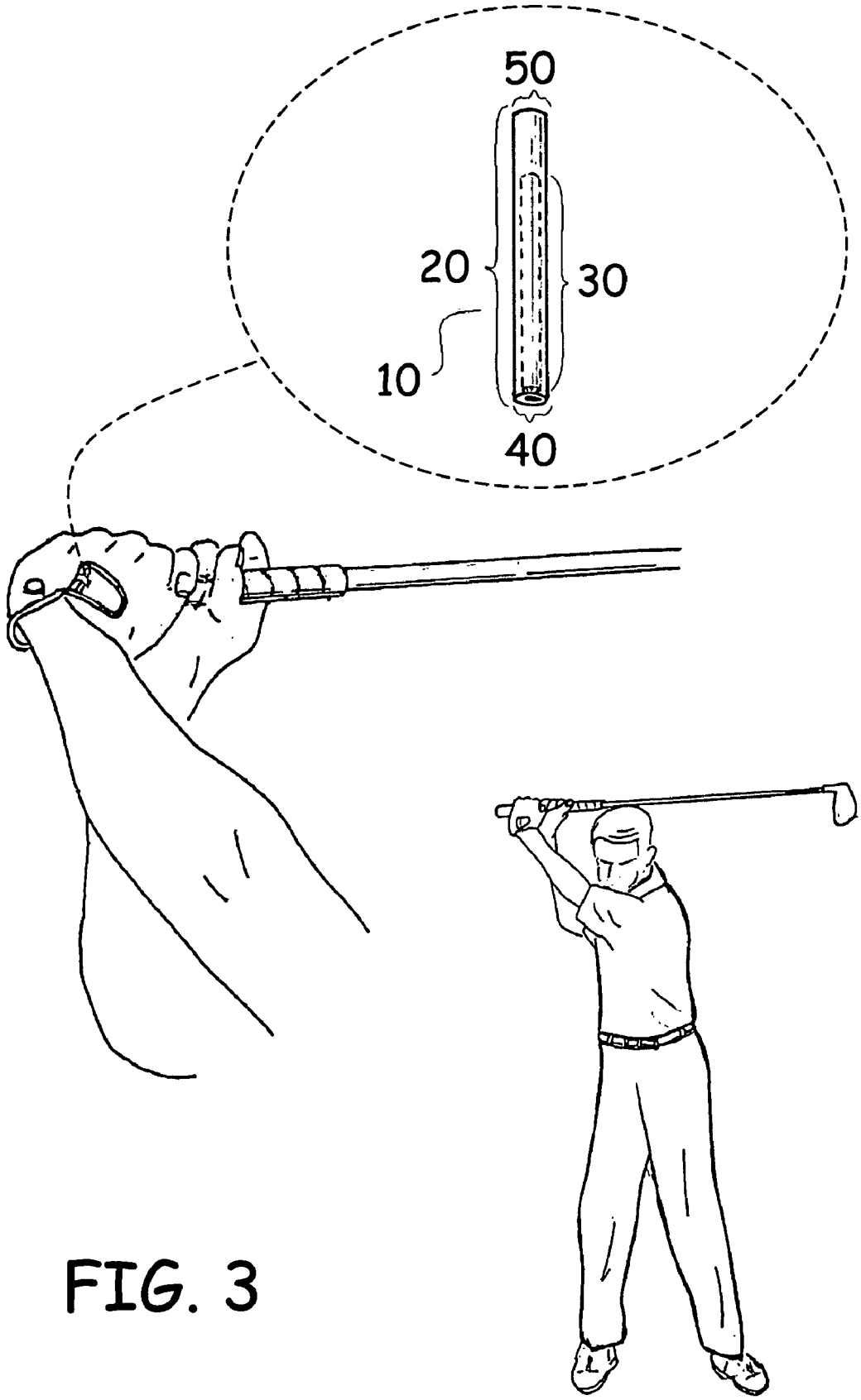
FIG. 3 is an example of an embodiment of the invention at the top of a swing.

FIG. 3 relates to a golfer's back swing in conjunction with the present invention. Once the club has reached the apogee of the back swing, the rod 30 slides down the tubular member 20 from second end 50, striking first end 40 and creating both a vibrational and an audible feedback indicator. Upon feeling or hearing the indicator, the golfer is aware that the apogee of the back swing has been reached. Further, there will not be any indicator (either vibrational or audible) at the top of the back swing if the golfer is swinging too fast, because momentum from the upward to the downward changes too quickly, preventing the rod 30 from dropping down the tubular member to make the vibrational and audible feedback indication of the swing having reached the apogee. Once the golfer has heard or felt the indictor, the golfer knows that the time has come to swing at the ball. After a slight pause, the golfer then swings down at the ball as shown in FIG. 4.

Figure 4:
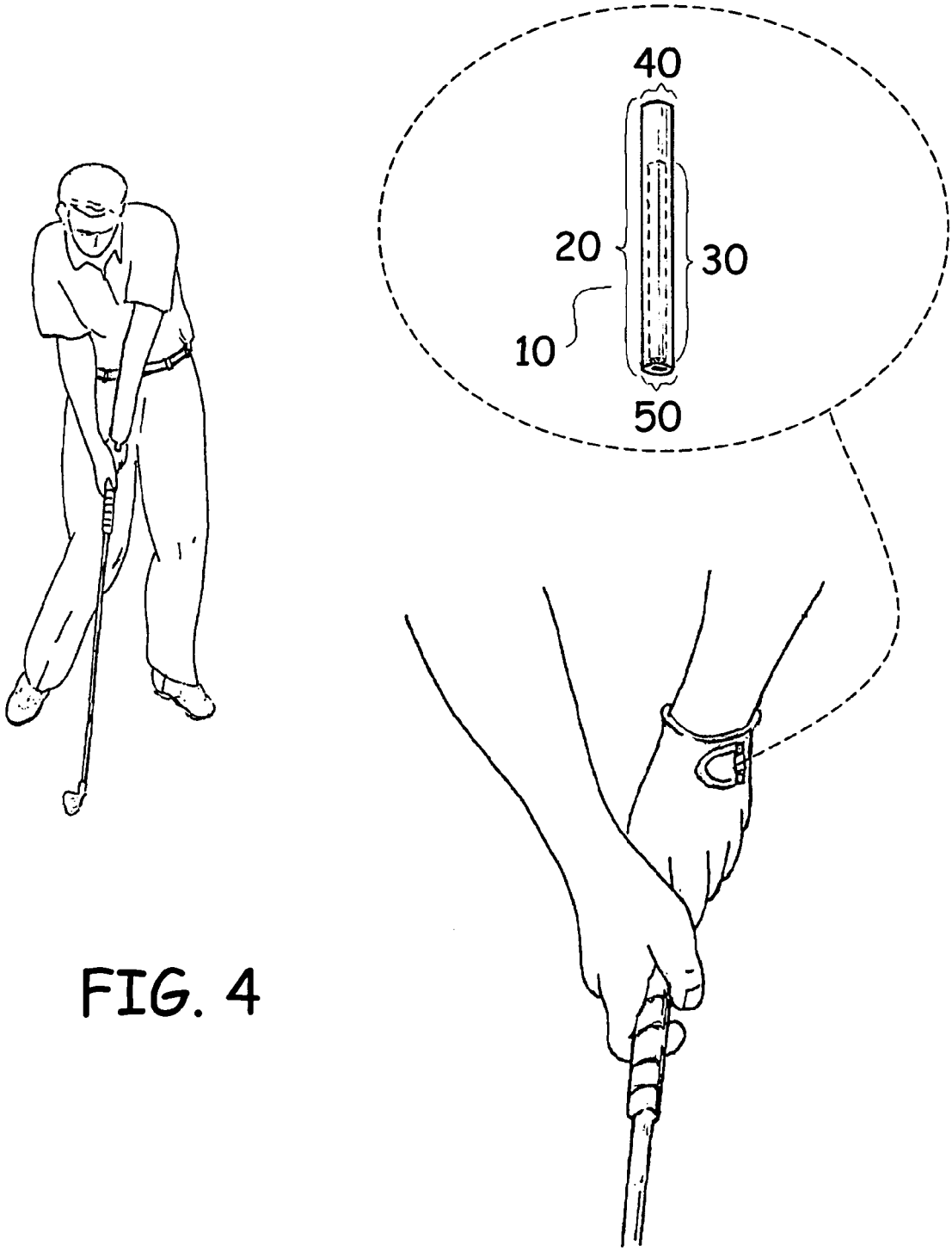
FIG. 4 is an example of an embodiment of the invention at the moment of addressing a golf ball at the bottom of a swing.

In FIG. 4, the golfer is hitting a ball (not shown) with the club at the perigee of the golf swing. On the way down the rod 30 is centrifugally forced to strike the second end 50 of the tubular member 20, and the golfer thus receives both the vibrational and audible feedback indication of club head acceleration.

Professional golf instructors advise that the follow-through in a golf swing is every bit as important as the back swing.

Figure 5:
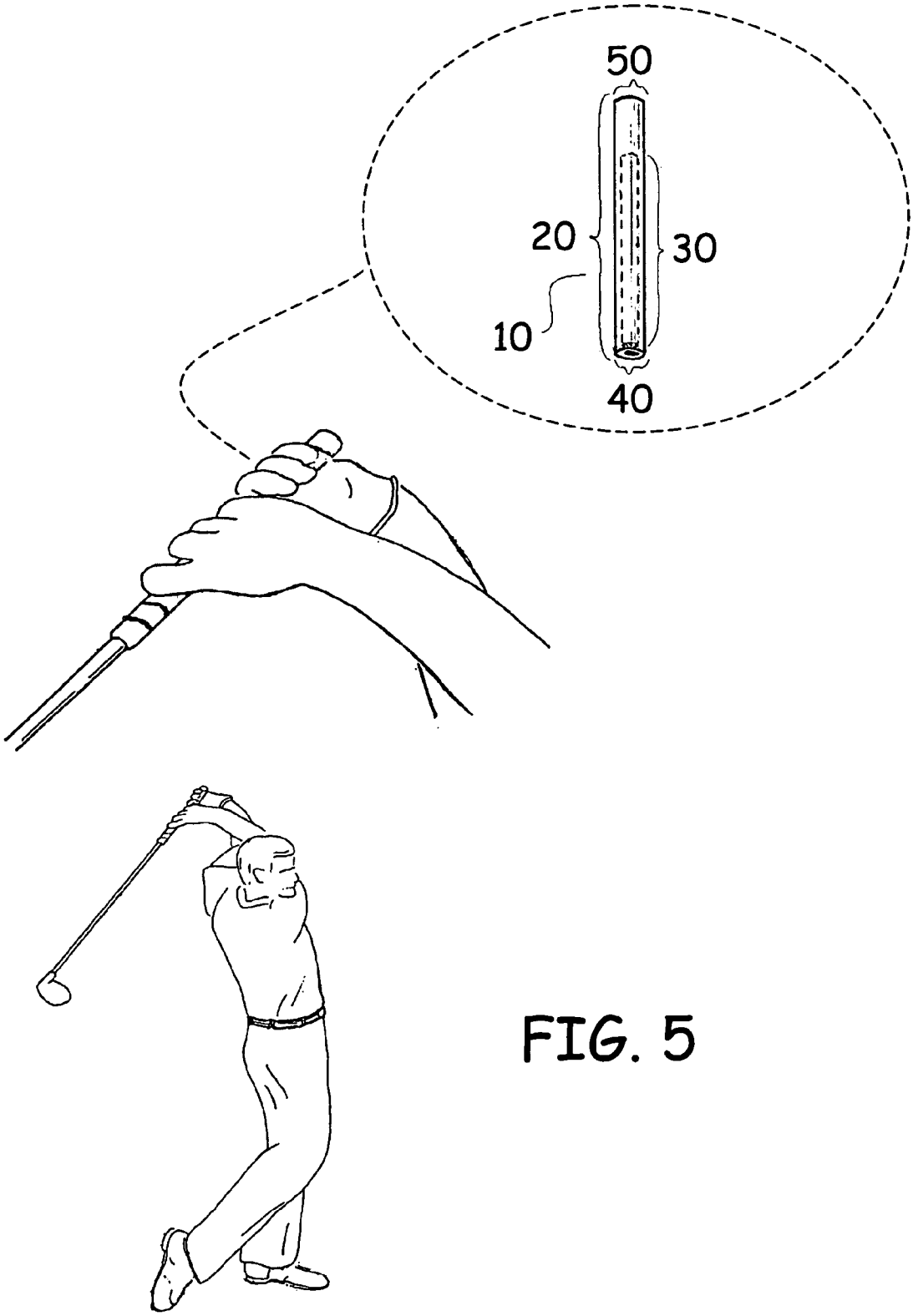
FIG. 5 is an example of an embodiment of the invention at the moment of having completely followed through with a golf swing.

FIG. 5 shows the golfer at the apogee of the follow-through swing, where, if the golfer properly follows through, the rod 30 falls down tubular member 20 to once again strike first end 40, creating both a vibrational and audible feedback indication that the apogee of the follow-through swing has been reached. It is only with proper follow-through (in conjunction with reaching a proper back swing apogee) that the golfer is able to perfect the art of the swing.

The above embodiments clearly have various advantages over the prior art. Advantageous characteristics in the embodiments of the present invention include: simplicity of design; ready availability of components for manufacture; cost-effectiveness in view of the previous; benefit of size (inconspicuousness and unobtrusiveness); and a fail-safe design.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments without the use of inventive faculty. For example, some or all of the features of the different embodiments discussed above may be deleted from the embodiment. Therefore, the present invention is not intended to be limited to the embodiments described herein but is to be accorded the widest scope defined only by the claims below and equivalents thereof.

What is claimed is:

1. A golf-swing timing training aid, said training aid including a body, said body comprising a tubular member and a rod; wherein said tubular member comprises first and second ends, said rod is located and movable within said tubular member, said first and second ends of said tubular member are of a diameter that prevents said rod from traveling outside of said tubular member, and said body is coupled to a golfing glove.

2. The golf-swing training aid of claim 1, wherein said body is attached via an attachment device to at least one of a golfing hand and a golf club, said body providing a vibrational impact which is capable of being felt or heard or both by a user, said vibrational impact resulting from said rod striking one of said first and second ends of said tubular member when: (i) said at least one of a golfing hand and a golf club is at the top of a swing, (ii) said at least one of a golfing hand and a golf club is on the down swing, and (iii) said at least one of a golfing hand and a golf club has followed through.

3. The golf-swing trailing aid of claim 1, wherein said rod is made of metal with a specific gravity greater than 2.

4. The golf-swing training aid of claim 1, wherein said tubular member is made of material selected from a group consisting of: metal, plastic and ceramic.

5. The golf-swing training aid of claim 1, wherein said tubular member has an inner diameter equal to or less than about ¼ inch.

6. The golf-swing training aid of claim 1, wherein said tubular member has an outer diameter equal to or less than about 5/16 inch.

7. A golf-swing timing training aid comprising:

a tubular member having first and second ends; and a rod located and free to move within said tubular member; wherein said first and second ends of said tubular member prevent said rod from traveling outside of said tubular member and said tubular member is attached to a golf glove.

8. The golf-swing timing training aid as defined by claim 7, wherein said tubular member has a length as measured from said first end to said second end that is greater than the length of said rod.

9. The golf-swing timing training aid as defined by claim 8, wherein said tubular member and said rod are operative to provide timing feedback to a golfer.

10. The golf-swing timing training aid as defined by claim 8, wherein said tubular member and said rod are operative to provide audible and/or vibrational timing feedback to a golfer.

11. A method of providing feedback during a golf-swing comprising the steps of:

coupling a tubular member having first and second ends to a hand of a golfer, said tubular member having a rod located and free to move within said tubular member;

addressing a golf ball with a golf club such that said rod moves to said first end of said tubular member;

initiating a golf swing beginning with a backswing and then a forward swing through the golf ball, during which said rod moves from the first end to the second end during the backswing and then said rod moves back to said first end of said tubular member during the forward swing, and then said rod moves to said second end during follow-through of the forward swing; and sensing movement of said rod within said tubular member to assist in providing timing feedback as a training aid to improve a golf swing.

12. The method of providing feedback during a golf-swing as defined by claim 11, wherein said step of sensing includes feeling vibrational impact of said rod moving from end to end.

13. The method of providing feedback during a golf-swing as defined by claim 11, wherein said step of sensing includes listening for a sound caused by impact of said rod moving from end to end.

14. The method of providing feedback during a golf swing as defined by claim 11, wherein said coupling comprises a golf glove.

15. The method of providing feedback during a golf swing as defined by claim 11, wherein said rod is made of a metal with a specific gravity greater than about 2.

16. The method of providing feedback during a golf swing as defined by claim 11, wherein said tubular member has an outer diameter equal or less than about 5/16 inch.

17. The method of providing feedback during a golf swing as defined by claim 11, wherein said tubular member has an inner diameter equal or less than about ¼ inch.

18. The method of providing feedback during a golf swing as defined by claim 11, wherein said tubular member is made of material selected from a group consisting of: metal, plastic and ceramic.

19. A sports-swing timing training aid, said training aid including a body, said body comprising a tubular member and a rod; wherein said tubular member comprises first and second ends, said rod is located and movable within said tubular member, said first and second ends of said tubular member are of a diameter that prevents said rod from traveling outside of said tubular member, and said body is coupled to a sporting glove.

20. The sports-swing training aid of claim 19, wherein said rod is made of metal with a specific gravity greater than 2.

21. The sports-swing training aid of claim 19, wherein said tubular member is made of material selected from a group consisting of: metal, plastic and ceramic.

22. The sports-swing training aid of claim 19, wherein said tubular member has an inner diameter equal to or less than about ¼ inch.

23. The sports-swing training aid of claim 19, wherein said tubular member has an outer diameter equal to or less than about 5/16 inch.

24. The sports-swing timing training aid as defined by claim 19, wherein said tubular member and said rod are operative to provide audible and/or vibrational timing feedback.

25. The sports-swing training aid of claim 19, wherein said body is attached via an attachment device to at least one of a sports hand and a sports club, said body providing a vibrational impact which is capable of being felt or heard or both by a user, said vibrational impact resulting from said rod striking one of said first and second ends of said tubular member when: (i) said at least one of a sports hand and a sports club is at the beginning of a swing, (ii) said at least one of a sports hand and a sports club is in the middle of the swing, and (iii) said at least one of a sports hand and a sports club has followed through.

26. A sports-swing timing training aid comprising:

a tubular member having first and second ends; and a rod located and free to move within said tubular member; wherein said first and second ends of said tubular member prevent said rod from traveling outside of said tubular member and said tubular member is attached to a sports glove.

27. The sports-swing timing training aid as defined by claim 26, wherein said tubular member has a length as measured from said first end to said second end that is greater than the length of said rod.

28. The sports-swing timing training aid as defined by claim 26, wherein said tubular member and said rod are operative to provide timing feedback during a sports swing.

29. A method of providing feedback during a sports-saving comprising the steps of:

coupling a tubular member having first and second ends to a gloved sports hand, said tubular member having a rod located and free to move within said tubular member;

addressing a ball with a sports club such that said rod moves to said first end of said tubular member;

initiating a sports swing beginning with a backswing and then a forward swing through the ball, during which said rod moves from the first end to the second end during the backswing and then said rod moves back to said first end of said tubular member during the forward swing, and then said rod moves to said second end during follow-through of the forward swing; and sensing movement of said rod within said tubular member to assist in providing timing feedback as a training aid to improve a sports swing.

30. The method of providing feedback during a sports-swing as defined by claim 29, wherein said step of sensing includes feeling vibrational impact of said rod moving from end to end.

31. The method of providing feedback during a sports-swing as defined by claim 29, wherein said step of sensing includes listening for a sound caused by impact of said rod moving from end to end.

32. The method of providing feedback during a sports swing as defined by claim 29, wherein said rod is made of a metal with a specific gravity greater than about 2.

33. The method of providing feedback during a sports swing as defined by claim 29, wherein said tubular member has an outer diameter equal or less than about 5/16 inch.

34. The method of providing feedback during a sports swing as defined by claim 29, wherein said tubular member has an inner diameter equal or less than about ¼ inch.

35. The method of providing feedback during a sports swing as defined by claim 29, wherein said tubular member is made of material selected from a group consisting of: metal, plastic and ceramic.

* * * * *